US008043400B1

(12) United States Patent
Stephens et al.

(10) Patent No.: US 8,043,400 B1
(45) Date of Patent: Oct. 25, 2011

(54) SYSTEM AND METHOD FOR THE THERMAL PROCESSING OF ORE BODIES

(76) Inventors: Thomas E. Stephens, Spokane, WA (US); Vaughn K. Boyman, Spokane, WA (US); Joseph A Diaz, Spokane, WA (US); Christopher E. Gordon, Spokane, WA (US); Gerald Engdahl, Spokane, WA (US)

( * ) Notice: Subject to any disclaimer, the term of this patent is extended or adjusted under 35 U.S.C. 154(b) by 0 days.

(21) Appl. No.: 13/158,336

(22) Filed: Jun. 10, 2011

(51) Int. Cl.
*C22B 4/08* (2006.01)

(52) U.S. Cl. ..... 75/10.14; 266/217; 266/157; 373/22; 373/25

(58) Field of Classification Search ..... 75/10.14; 266/217, 157; 373/22, 25
See application file for complete search history.

(56) References Cited

U.S. PATENT DOCUMENTS

| | | | | |
|---|---|---|---|---|
| 3,925,177 | A | 12/1975 | Kofoid | |
| 4,386,258 | A | 5/1983 | Akashi et al. | |
| 4,745,338 | A | 5/1988 | Hollis | |
| 2008/0298425 | A1 * | 12/2008 | Jackson | 373/108 |

* cited by examiner

*Primary Examiner* — Roy King
*Assistant Examiner* — Tima M McGuthry Banks
(74) *Attorney, Agent, or Firm* — Priya Sinha Cloutier

(57) ABSTRACT

The Inventive System disclosed herein relates to an improved system for extracting metals from ore.

4 Claims, 10 Drawing Sheets

SYSTEM AND METHOD FOR THE THERMAL PROCESSING OF ORE BODIES

CROSS-REFERENCES TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

TECHNICAL FIELD

The Inventive System disclosed herein relates to an improved system for extracting metals from ore.

BACKGROUND OF INVENTION

Ore is defined as a mineral or an aggregate of minerals from which a valuable constituent and more specifically, at least one metal can be extracted. Ore must be processed to separate unwanted organics and minerals, or other inorganic materials, from metal. Once ore is processed, it may be refined to separate metals. For example, Cupellation is a refining method used to separate silver from lead. Complex ores, as used herein, means an ore in which the ratio of metal to aggregate organic and inorganic material is low or ore in which metal is difficult to separate from aggregate organic and inorganic material.

Known methods for processing include exposing lime and/or cyanide to ore slurry or other similar leaching processes. These methods are inefficient and costly when dealing with complex ores. Consequently, metals in complex ores may not be extracted. Even if known methods for processing ore were efficient and inexpensive, they are toxic to the environment. These methods release toxic gases and chemicals and unprocessed water into the environment. Known methods may also require large energy input.

The Inventive System, described herein, provides methods and apparatus that is used to process complex ores efficiently and inexpensively. The Inventive System is also "green":

(1) The air emissions meet or are significantly below current county, state, and federal regulatory limits;

(2) Process water is treated and disposed of using Best Available Control Technology (BACT), to allow release in to the local sewer system.

(3) Power supply is regulated so that it is more efficiently used.

A. DESCRIPTION OF PRIOR ART

The thermal treatment of minerals and metallurgical ores and concentrates to bring about physical and chemical transformations in the materials to enable recovery of metals is known in the art. Such treatment may produce saleable products such as pure metals, or intermediate compounds or alloys suitable as feed for further refinement. It is known that plasma environments can provide high temperatures to fuel thermal treatment to refine metal. For example, plasma environments have been used to convert iron slag to pure iron. More specifically, low temperature plasma torches have been used to bring about thermal and physical changes in processed ore. Processed ore is generally placed in a crucible and heated; this type of system can be though of as a furnace.

In a furnace environment aggregate organic and inorganic materials cannot be removed with just the addition of heat. Usually, environmentally toxic chemicals must be added to create an environment in which ore can be processed.

In order to process ore using a plasma reactor several issues must be considered. First, it is critical that feed ore is exposed to the high heat produced by the plasma torch for a period of time sufficient to cause melting or other reactions. Second, torch-consumable components show high failure rates and great inefficiencies. Third, it is known that high heat creates failure in prior art reactor walls. Fourth, prior art reactors cannot run at industrial efficiency. Processing ore at industrial efficiency requires: (a) a reactor that can process hundreds of pounds of ore within a short period of time; (b) constant reactor temperatures; (c) low failure rates and low material breakdown of the plasma torch and other reactor components; and (d) reactor parts that are easily accessible for service. Fifth, the ability to efficiently collect processed ore is vital. Finally, known reactors are not energy efficient.

B. INVENTIVE SYSTEM

The Inventive System provides a unique configuration that combines a plasma torch in conjunction with induction heat to process complex ores in order to remove unwanted organic and inorganic materials, leaving only metals at industrial efficiencies with no release of toxic chemicals or gases into the environment. The Inventive System is shown, generally, in FIGS. 1-2. It should be noted that the Inventive System may, however, be embodied in many different forms and should not be construed as limited to the embodiments set forth herein.

Referring to FIG. 1, in a first embodiment, the Inventive System comprises an AMT Reactor™ (10), a bag house (700), and an off-gas system (800): Ore enters the Inventive System at (1) and is processed by the AMT Reactor™ (10). In the simplest scenario, processed ore is removed from the Inventive System at (2).

As ore is processed through the AMT Reactor™ (10) it releases gases such as carbon, sulphur, oxygen, and various combinations thereof. As gases leave the AMT Reactor™ (10) at (3) ore particulates, having lower densities, may be pulled into the high temperature bag house (hereinafter "bag house") (700). The bag house (700) comprises a plurality of filters to capture ore particulates. Because some of the ore particulates entering the bag house (700) contain metal, the recovered ore particulates may be chemically treated (50) to remove unwanted material. In a preferred embodiment the chemical treatment (50) may be an acid or base treatment.

Gases continue to move from the bag house (700) to the off-gas system (800). The off-gas system (800) captures and cleans process gases from the AMT Reactor™ (10). The off-gas system (800) runs at a vacuum or below atmospheric pressure so that process gases move from the AMT Reactor™ (10) toward the off-gas system (800).

Referring to FIG. 2, in a second embodiment, the Inventive System further comprises a secondary melt system (900). At times metals are so ensconced in unwanted organic and inorganic materials that they cannot be completely processed in the AMT Reactor™ (10). In such a case the ore is also processed through a secondary melt system (900). The secondary melt system can be a second AMT Reactor™ (10) or conductive coils, for example. Even if a secondary melt system (900)

is used, desired metal may still be shrouded in unwanted organic and inorganic material as it leaves the secondary melt system (900) at (7). To remove the remaining unwanted organic and inorganic materials the ore may be further processed in chemical treatment (50).

In each of the above described embodiments, and any embodiments which are obvious variations thereof, the components of the Inventive System are attached to each other with high temperature ducting. The Inventive System, regardless of embodiment, uses a proprietary I/O system to control everything from ore feed rates to the type of gases released through the off-gas system (800). The I/O control system contemporaneously measures flow rates into the AMT Reactor™ (10), through the bag house (700), and the off-gas system (800). It instantaneously adjusts run environments so that gases and other toxins are appropriately treated before release into the environment. Consequently, the amount of toxic gas and material released is closely monitored and all released gases and materials are appropriately treated and meet or are below all local, state, or federal regulatory requirements.

BRIEF DESCRIPTION OF THE SEVERAL VIEWS OF THE DRAWINGS

Other features and advantages of the present invention will become apparent in the following detailed descriptions of the preferred embodiment with reference to the accompanying drawings, of which.

DETAILED DESCRIPTION OF THE INVENTION

The present invention is described more fully hereinafter with reference to the accompanying drawings, in which preferred embodiments of the invention are shown. This invention may, however, may be embodied in many different forms and should not be construed as limited to the embodiments set for herein; rather, these embodiments are provided so that this disclosure will be thorough and complete and will fully convey the scope of the invention to those skilled in the art.

In a preferred embodiment, the Inventive System comprises an AMT Reactor™ (10), a bag house (700), and off-gas system (800). In another embodiment, the Inventive System comprises an AMT Reactor™ (10), a bag house (700), an off-gas system (800) and a secondary melt system (900).

Figure 1:
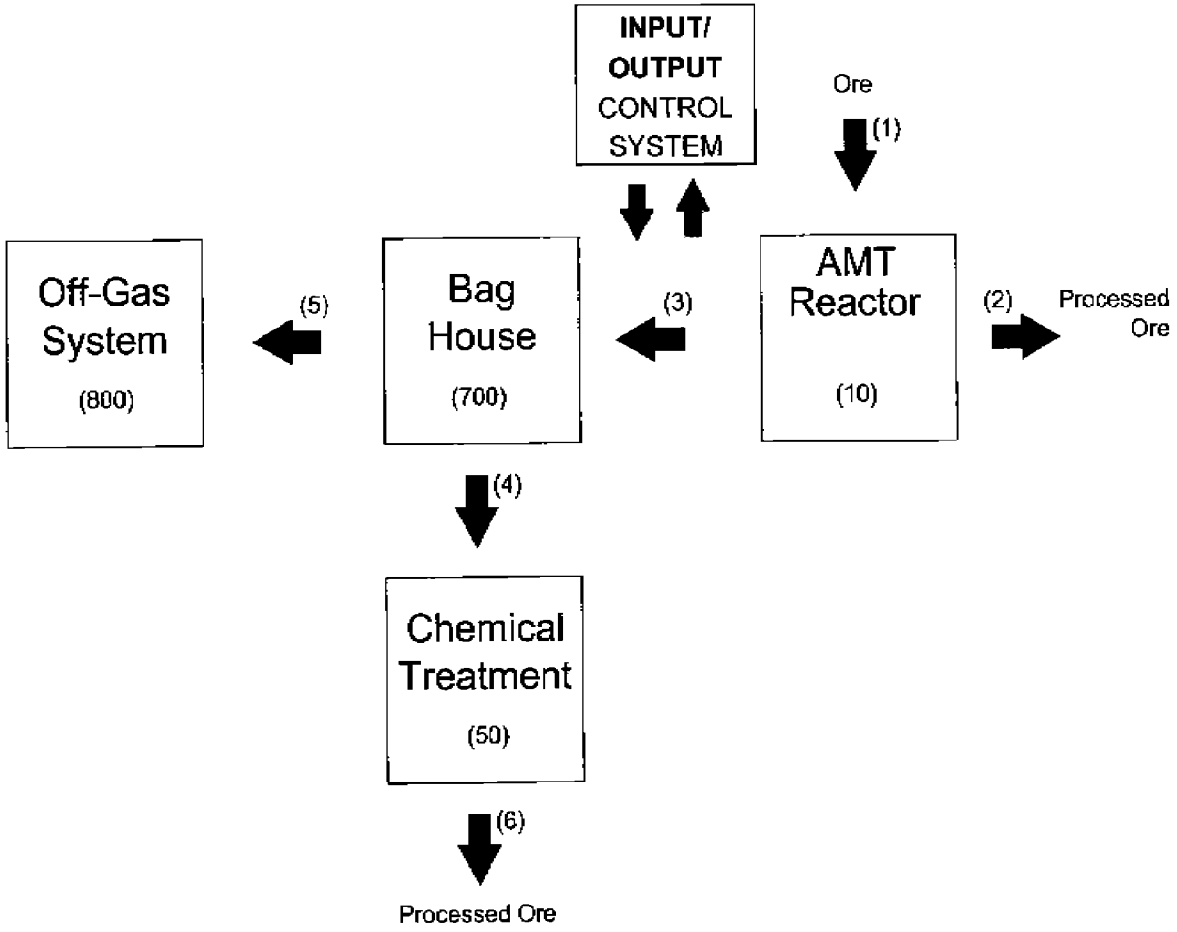
FIG. 1 is a flow chart showing one preferred embodiment of the inventive system.
Figure 2:
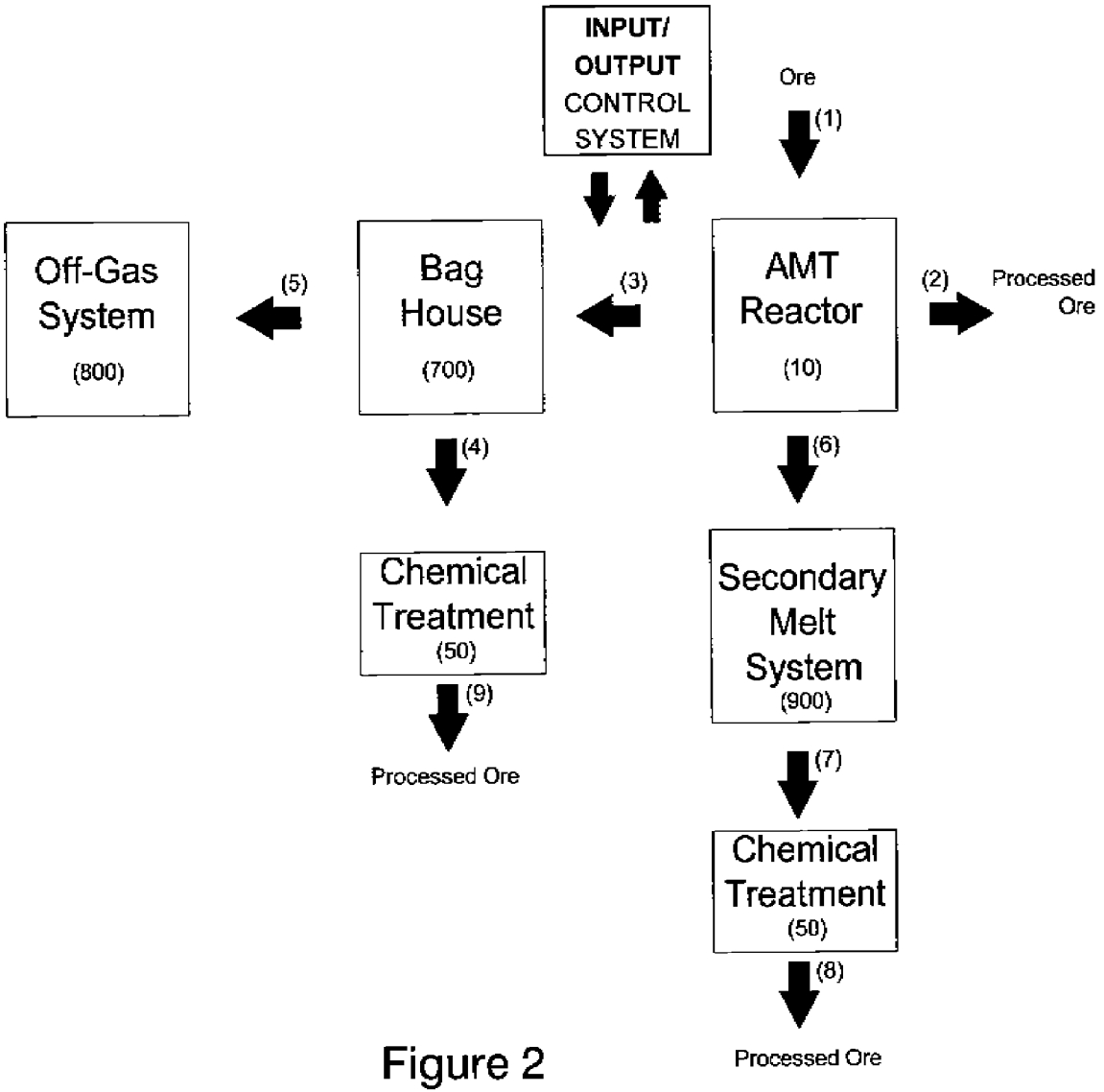
FIG. 2 is a flow chart showing a second preferred embodiment of the inventive system.
Figure 3:
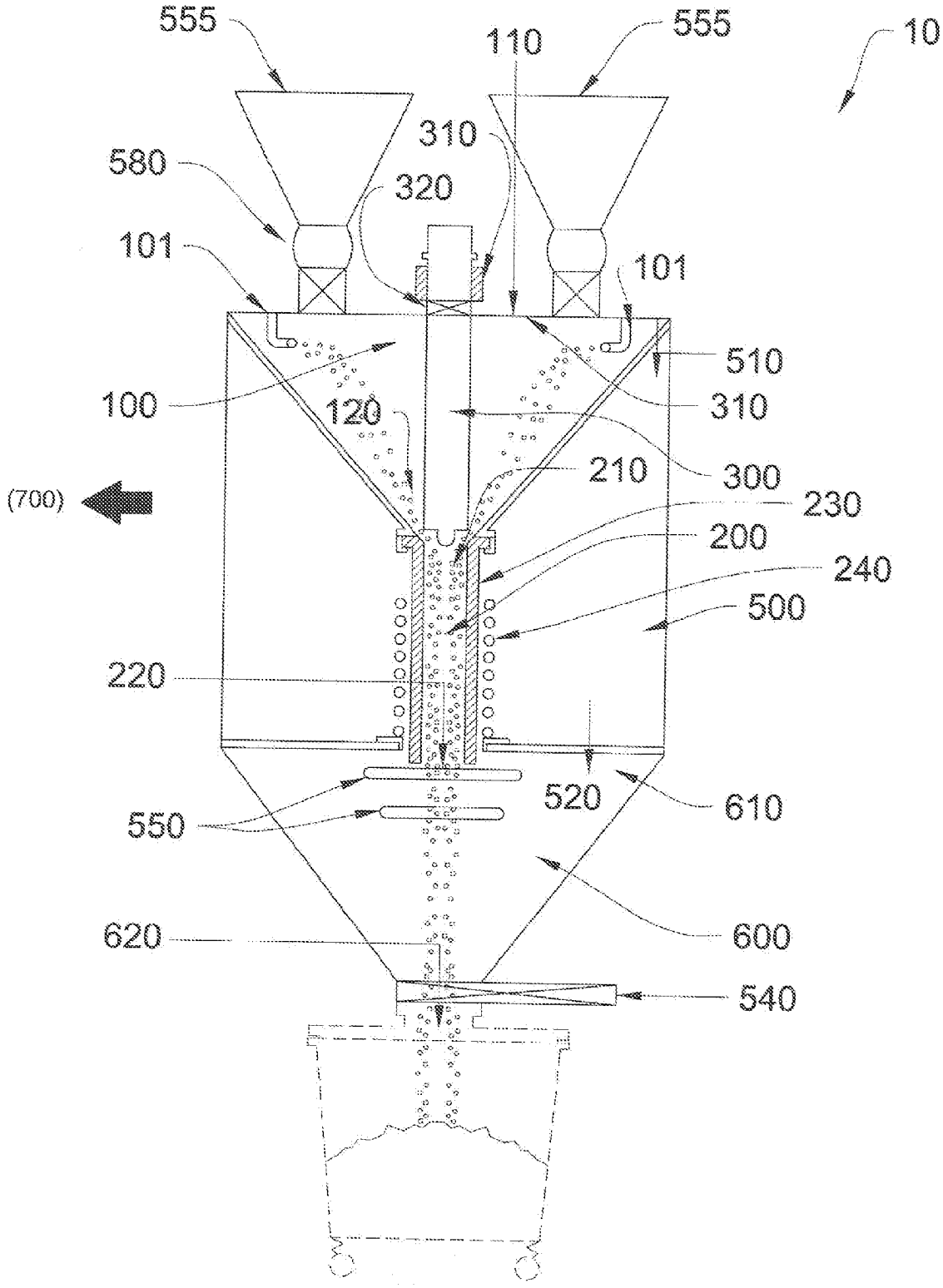
FIG. 3 is a cut-away view of the AMT Reactor™.
Figure 4:
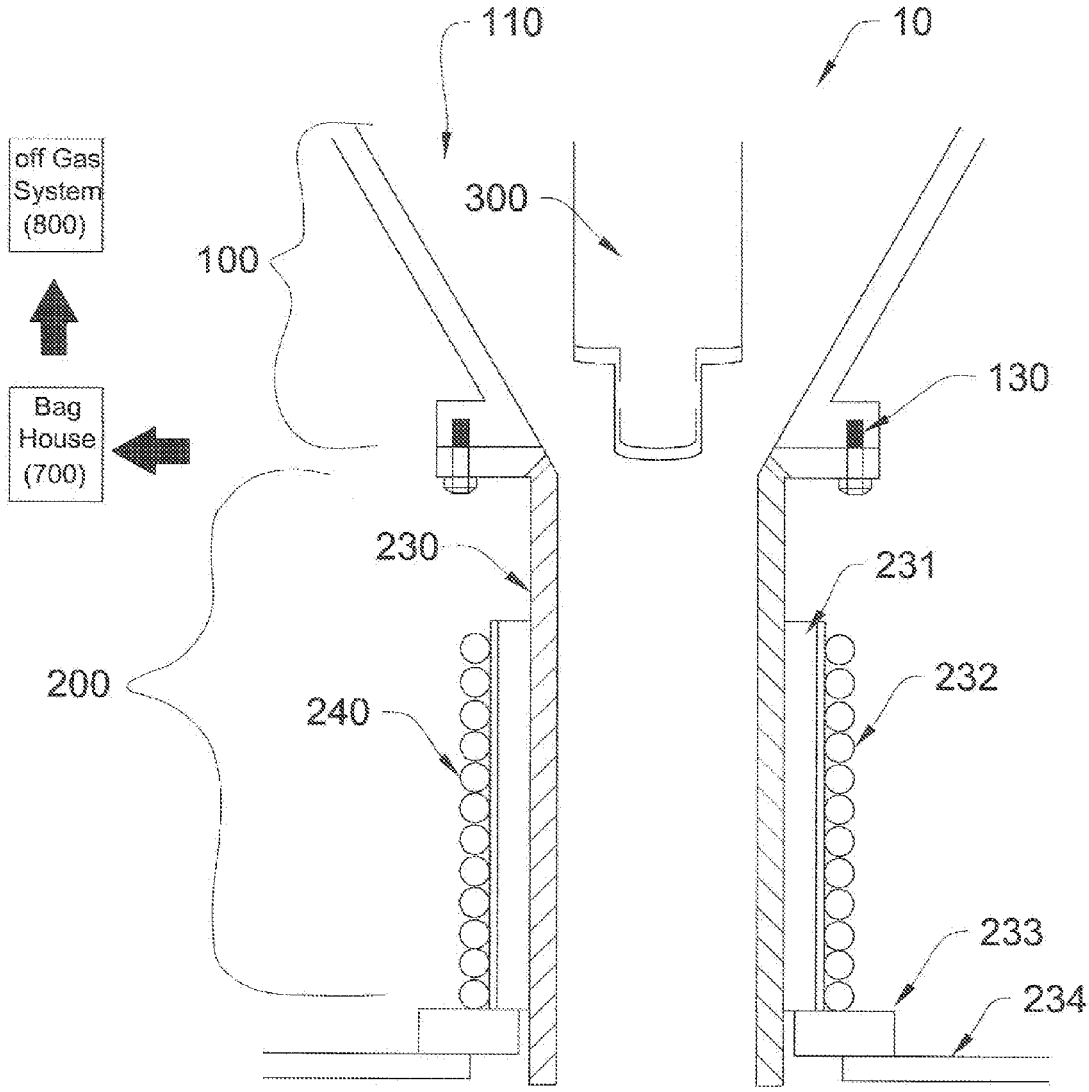
FIG. 4 is a detail, cut-away view of the AMT Reactor™.
Figure 5:
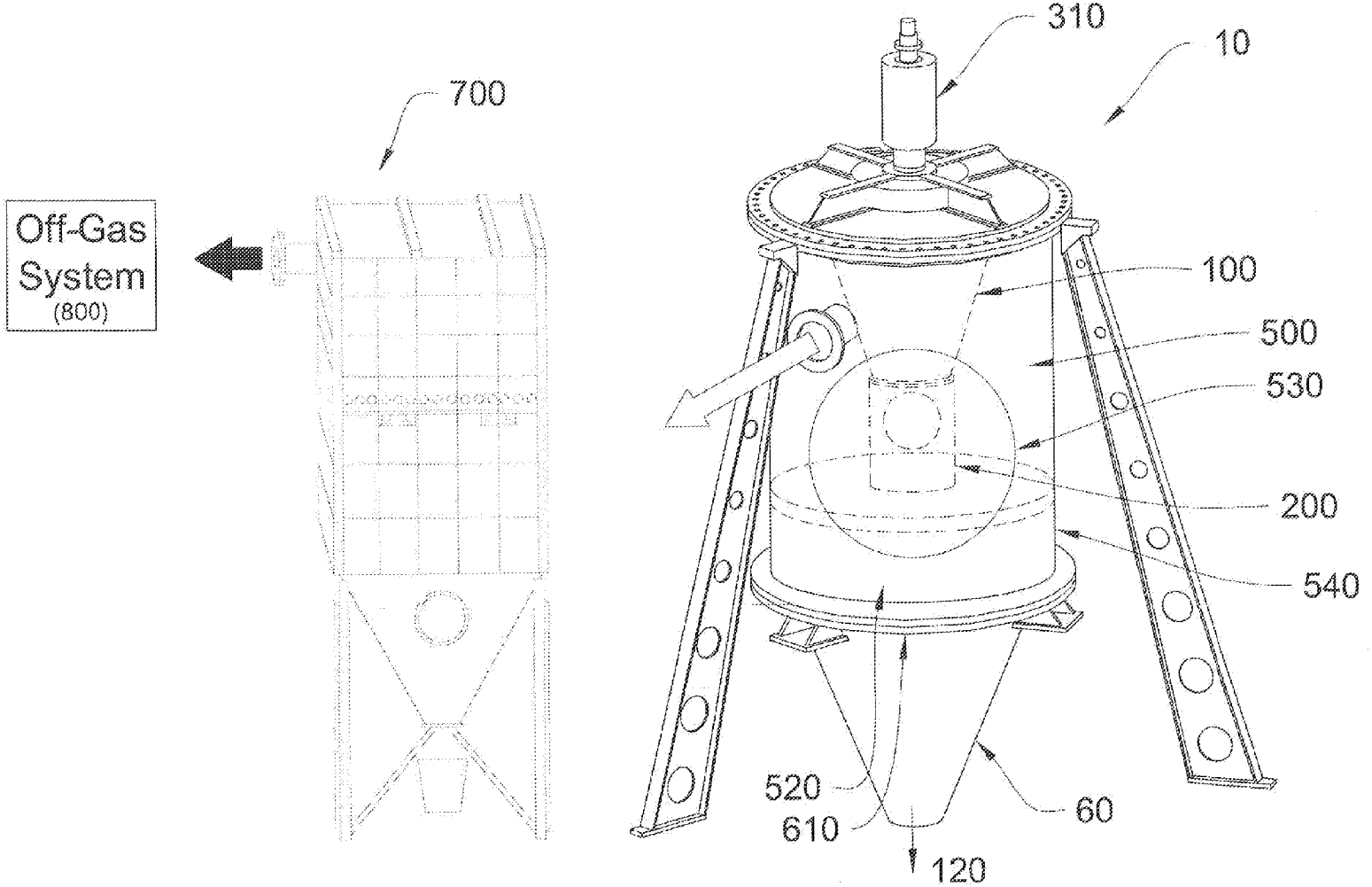
FIG. 5 is a schematic of the Inventive System.

AMT Reactor™. Referring to FIGS. 3-5, the AMT™ Reactor (10) comprising a first chamber or feed chamber (100), a second chamber or reaction chamber (200), and a plasma torch (300). The plasma torch (300) enters the reaction chamber (200) through the feed chamber (100). The plasma torch (300) has an active end and an inactive end where the active end is the anode end (refer to FIG. 9). The active end is placed into the reaction chamber (200). The depth of insertion is variable and is dependent upon factors including but not limited to torch size and AMT Reactor™ (10) size.

Figure 9:
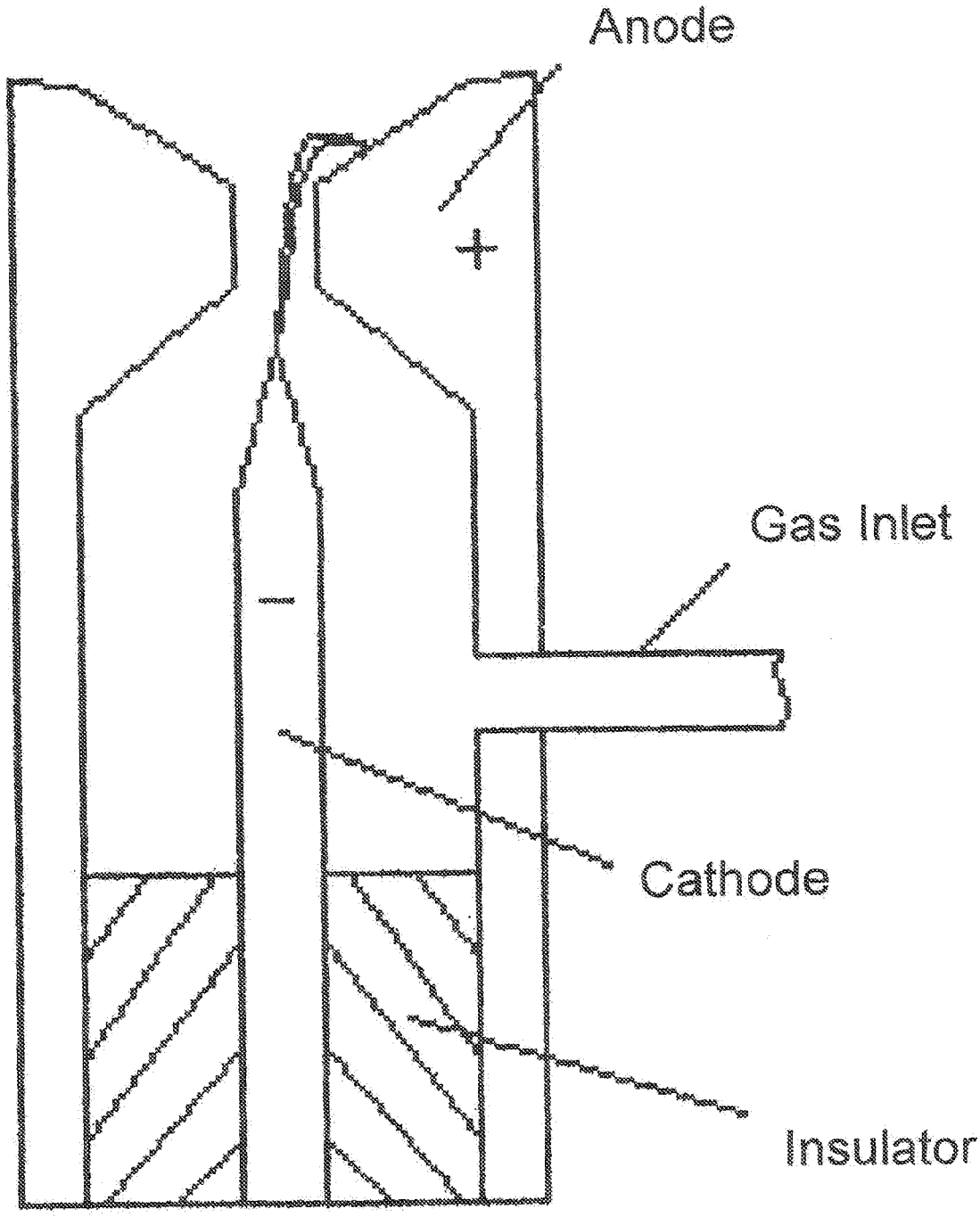
FIG. 9 is a cut-away view of a generic plasma torch.

Known methods are used to cool each component of the AMT Reactor™ (10); more specifically, AMT Reactor™ (10) components are cooled by circulating water and coolant through a coolant manifold. The manifold is controlled by the proprietary I/O system mentioned above. Known methods are used to provide electrical power to the AMT Reactor™ (10). Plasma torches are known in the art. A generic plasma torch is shown in FIG. 9. Burn gas enters the torch at a cathode and travels toward an electrical arc, becoming plasma, and exits through an anode throat. The cathode in this instance is positively charged and the anode is negatively charged. The two are electrically isolated from one another. The conductive gas that becomes plasma is introduced at a velocity that stretches the plasma arc beyond the anodes throat to thermally react the ore being fed before the arc returns and terminates on the face of the anode. Many different types of burn gases have been used with plasma torches including air, oxygen, nitrogen, hydrogen, argon, $CH_4$, $C_2H_4$ and $C_3H_6$.

In a preferred embodiment, the plasma torch (300) is of the type where burn gas is fed into the plasma torch (300) tangent to the anode and electrode. The plasma torch polarity is set to run in non-transfer mode. In a transfer plasma torch the arc is looped from the torch's anode to a "work piece" that has a negative polarity. The size of the arc is limited in size by the distance between the anode and the "work piece". A non-transfer plasma torch has both negative and positive polarity. In the AMT Reactor the arc is looped from the electrode to the torch nozzle and does not have a size limitation consequently, ore can be continuously processed through the AMT Reactor.

In a preferred embodiment, the feed chamber (100) is conically shaped having an input end (110) and an output end (120) where the input end (110) has a larger diameter than the output end (120). The input end (110) has a diameter sufficient in size to accept a plasma torch (300) where the plasma torch is of sufficient size to create the necessary temperature to create reaction in the ore. A person having ordinary skill in the art will know that the voltage of the plasma torch (300) will vary depending on various factors including but not limited to the type of ore that is processed and the size of the AMT™ Reactor (10), among other factors.

In a preferred embodiment, the walls of the feed chamber (100) are angled. The angled feed chamber (100) walls allow more control over the feed rate of the ore into the AMT Reactor™ (10). For example, ore having a smaller density may not properly enter into the reaction chamber (200) if the feed chamber (100) walls were not angled. The walls of the feed chamber (100) are angled at approximately 60°. However, depending on AMT Reactor™ (10) size and other factors including but not limited to torch size and ore type, this angle may change.

In a preferred embodiment, the plasma torch (300) is activated using helium. Because helium is costly, once the plasma torch (300) has been established, it runs on argon. However, it should be noted that apart from cost and temperature considerations, any known or unknown burn gas may be used to operate the plasma torch (300).

Referring to FIGS. 4-8, the feed chamber (100) further comprises an ore feed system (550). The ore feed system comprises at least one feed hopper (555) and a screw feeder system (580). The screw feeder system comprises a screw conveyor (556) and feed chamber valve (557) (shown in FIG. 7). Optimally, the ore feed system (550) has at least two feed hoppers (555) so that one feed hopper (555) can be loaded while the other is discharged into the AMT™ Reactor (10).

To deliver ore to the feed chamber (100) oxygen is aspirated from the at least one feed hopper (555). The at least one feed hopper (555) is back filled with, a carrier gas. When the feed chamber valve (557) and the screw conveyor (556) are in the open position, feed ore and gas are delivered to the AMT Reactor™ (10) through the feed chamber (100) through at least one feed tube (101) into the reaction chamber (200). The ore feed system (550) delivers feed ore and carrier gas along the same axis at which the plasma torch (300) is inserted into the AMT Reactor™(10). In a preferred embodiment, nitrogen is used as the carrier gas.

Figure 6:
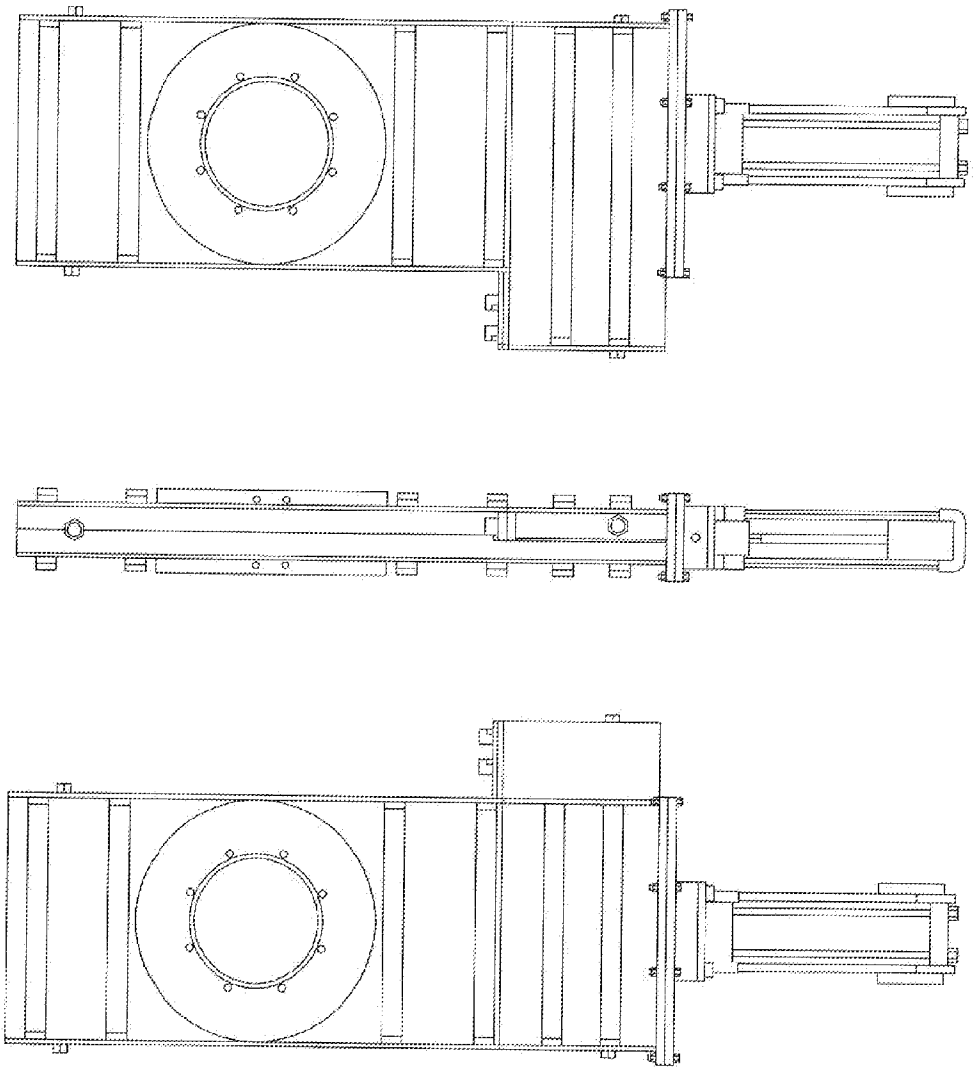
FIG. 6 is a schematic of the torch isolation valve.

Referring to FIGS. 4-6, the reaction chamber (200) is, generally, tubular in shape and comprises an input end (210) and an output end (220). The length of reaction chamber (200) is dependent on various factors including but not limited to the AMT Reactor™ (10) size, plasma torch (300) size, and ore feed rates, amongst others.

The output end (120) of the feed chamber (100) mates with input end (210) of the reaction chamber (200) using a flange (130). The reaction chamber (200) is radially surrounded by graphite (230). The graphite (230) is insulated and then radially surrounded by heating coils (240). In a preferred embodiment, the heating coils (240) are induction coils (240). The graphite (230) is radially insulated by a graphite insulation blanket (231) and then a refractory lining (not shown). The purpose of the induction coils (240) is two-fold: (a) to keep the reactor temperature at a relatively constant level; and (b) to create an electromagnetic field which stirs ore as it passes through the reactor. In this configuration, graphite is allowed to expand or contract as necessary.

The area between the reaction chamber (200) and the graphite (230) must be sealed to keep material from migrating outside the AMT Reactor™ (10) and to protect induction coils (240) from direct plasma arcing which would burn the coils.

The output end (220) of the reaction chamber (200) projects through the refractory base plate (233). The induction coil (240) is supported by the refractory base plate (233); the refractory base plate (233) sits on a water cooled base plate (234). This configuration allows the expansion of the reaction chamber (200) as necessary.

The plasma torch (300) enters the reaction chamber (200) through the torch seal housing (310) which mates with a torch isolation valve (320) (See also FIG. 6). The torch isolation valve (320) creates a vacuum seal between itself and the reaction chamber (200) and between itself and the torch seal housing (310). The torch seal housing (310) is made of non-conductive material.

This configuration electrically isolates the plasma torch (300) from the rest of the AMT Reactor™ (10). To perform maintenance on the plasma torch (300), the torch isolation valve (320) is sealed to maintain the atmosphere in the reaction chamber (200), and the plasma torch (300) is lifted out of the AMT Reactor™ (10).

The feed chamber (100) and the reaction chamber (200) are encompassed by the tertiary chamber (500). The tertiary chamber (500) allows particulate and gas exhaust into a bag house (700). In a preferred embodiment, the tertiary chamber (500) comprises at least one chamber door (530). The chamber door (530) allows access for maintenance. The tertiary chamber (500) is tubular in shape and comprises an input end (510) and an output end (520).

To operate the AMT Reactor™ (10) air is aspirated, to create a low oxygen environment, from the reaction chamber (200) using a vacuum pump. The system then isolates the vacuum pump with a valve. The AMT Reactor™ (10) is then backfilled with inert gas to near atmospheric pressure. Then the plasma torch (300) is ignited, and a mixture of feed ore and gas are backfilled into the AMT Reactor™ (10). The at least one feed hopper (555) is aspirated to remove oxygen. The at least one feed hopper (555) is then backfilled with a gas, preferably the same as the burn gas, pushing ore into the AMT Reactor™ (10) through feed tubes (101).

Figure 7A:
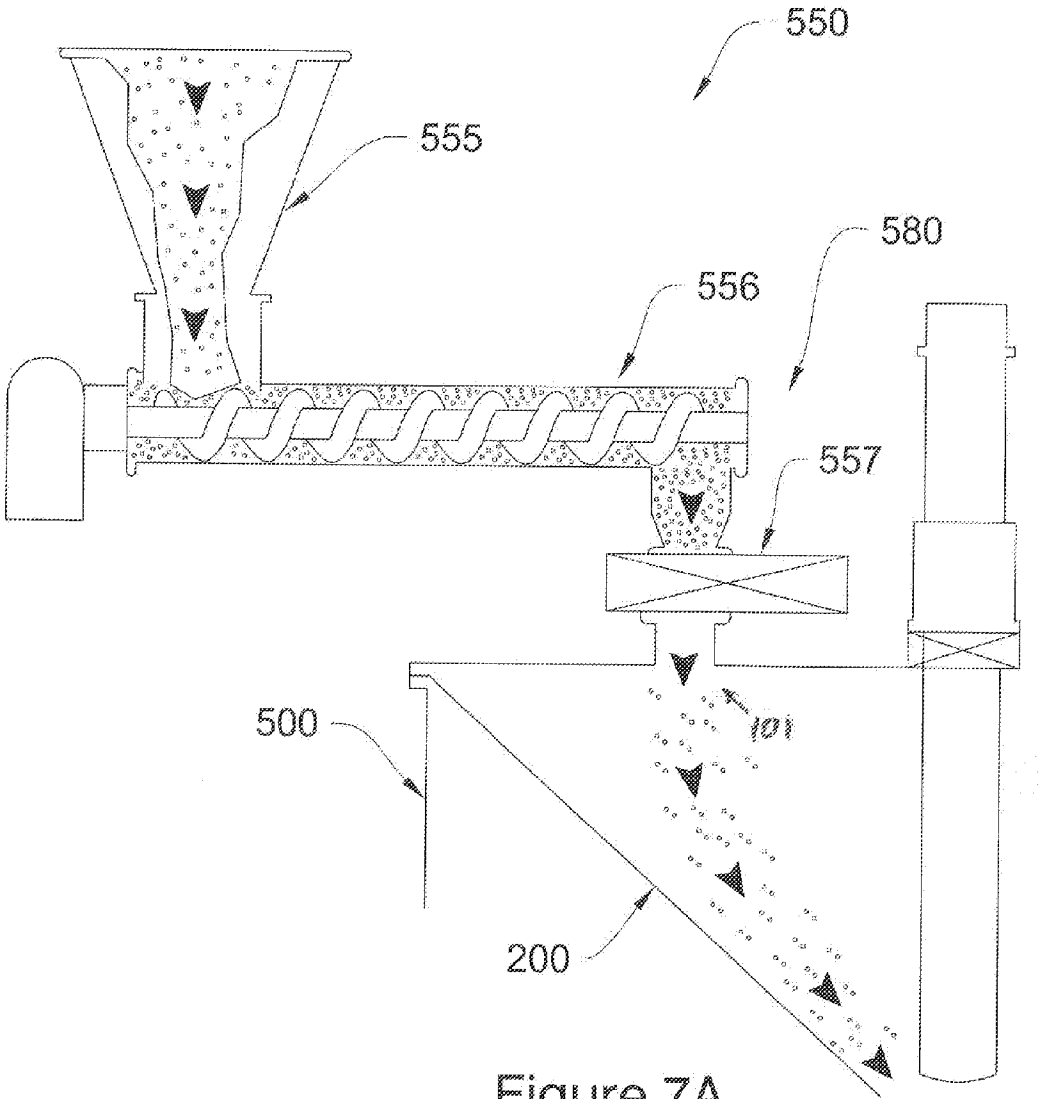
FIG. 7A shows a cut-away view of an embodiment of the ore feed system.
Figure 7B:
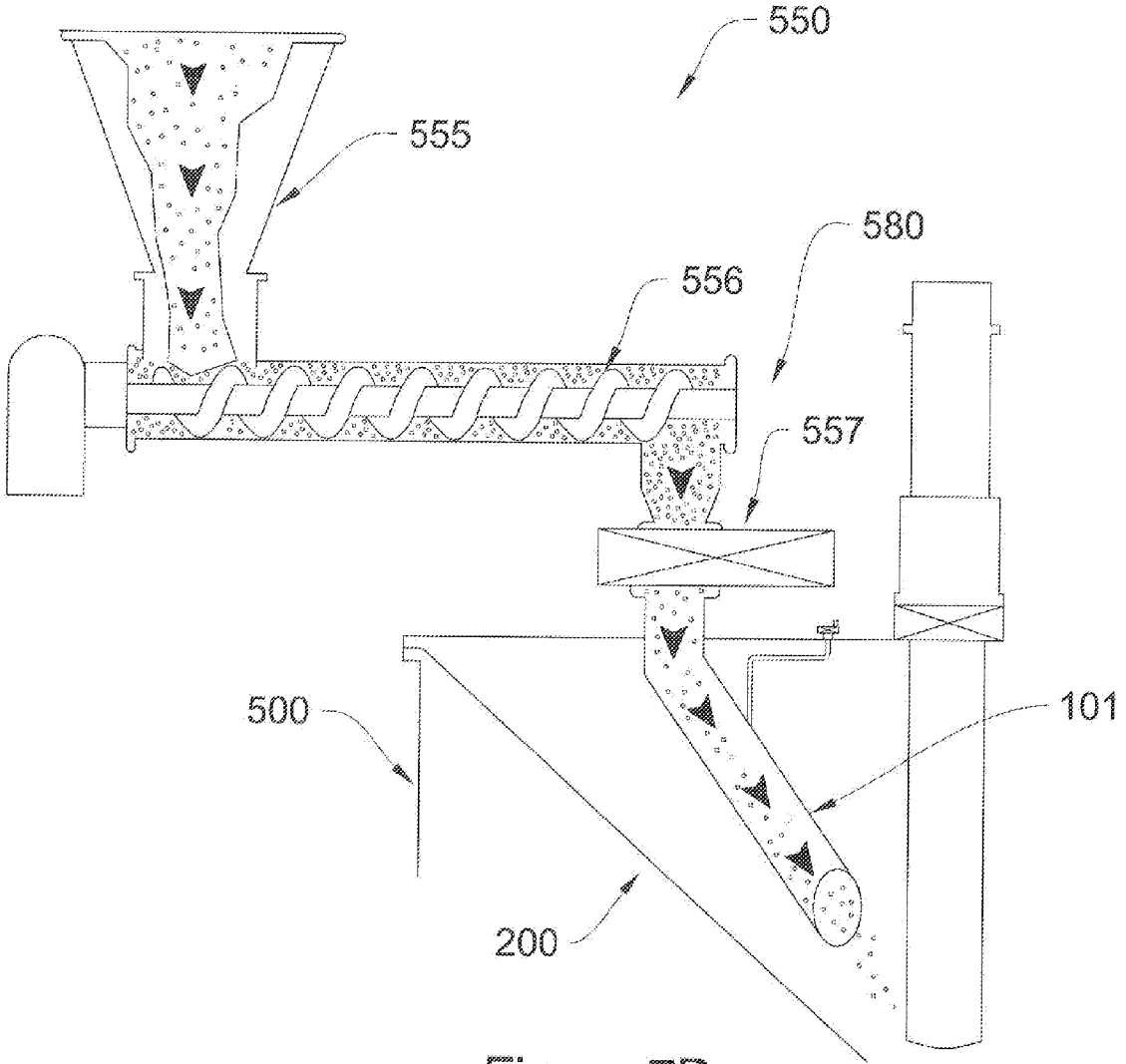
FIG. 7B shows a cut-away view of another embodiment of the ore feed system.
Figure 8:
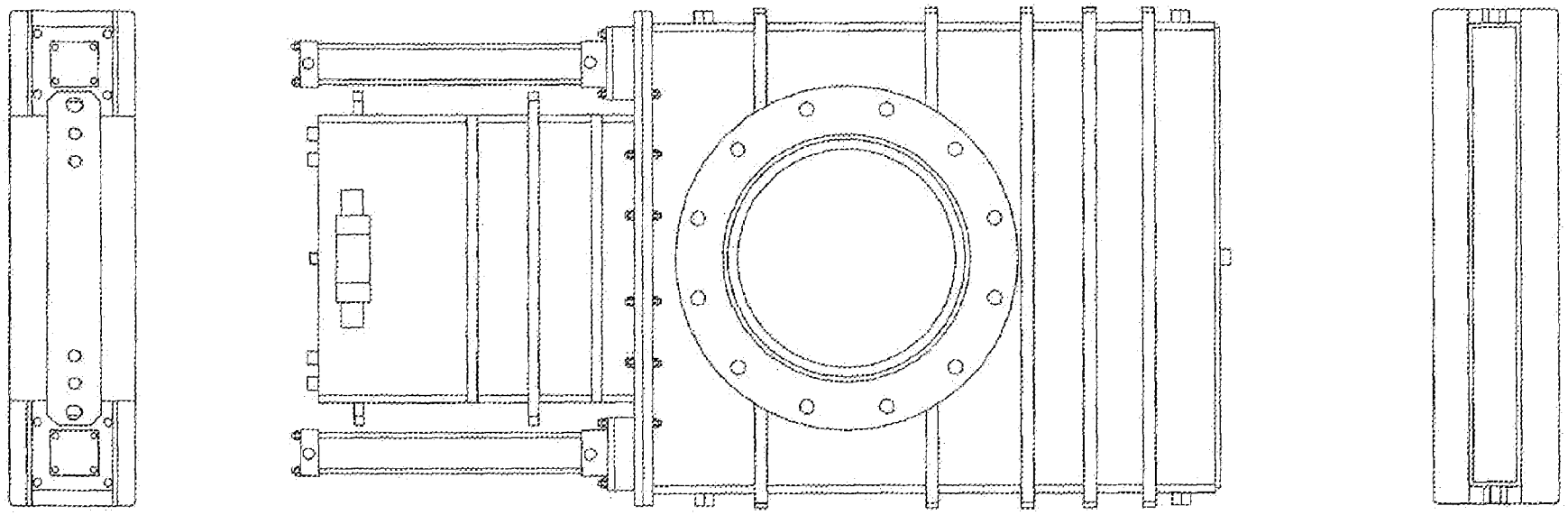
FIG. 8 is a schematic of the fourth-chamber isolation valve.

Referring to FIG. 7, in one preferred embodiment, the at least one feed tube (101) simply releases ore into the reaction chamber (200). Referring to FIG. 7B, in a second preferred embodiment, the at least one feed tube (101) is of an extended length so that it delivers ore closer to the plasma torch (300). The extended feed tube (101) is adjustable and is angled. The angle is similar to that of the feed chamber (200) wall; the angle and length are dependent upon the type of ore that is being processed.

The output end (520) of the tertiary chamber (500) comprises at least one quench ring (550). The at least one quench ring (550) comprises a plurality of multiple gas nozzles. As processed ore falls through the reaction chamber (200), it passes through the quench rings (550) where it is sprayed by gas. Preferably, the quench gas is a noble gas. The purpose of the spray is twofold: (a) to atomize processed ore; and (b) to cool processed ore. Preferably, the gas nozzles are pointed toward the center of the at least one quench ring (550) and down toward the output end (620) of a fourth chamber (600) (discussed below).

The fourth chamber (600) comprises an input end (610) and an output end (620). In a preferred embodiment, the fourth chamber is conically shaped where the input end (610) has a diameter larger than the output end (620). The output end (520) of the tertiary chamber (500) mates with the input end (610) of the fourth chamber. The output end (620) of the fourth chamber (600) comprises a lower cone isolation valve (540) (See also FIG. 8). The lower cone isolation valve (540) allows the apparatus to maintain a low oxygen environment while allowing processed ore to be removed and collected into a collection can or hopper.

Bag House. As discussed above, particulates from AMT Reactor™ (10) may flow to a bag house (700). The bag house (700) is attached to tertiary chamber (500). As discussed above, there is a negative pressure that allows particulate matter to flow from the AMT Reactor™ (10) to the bag house (700). The bag house (700) comprises at least one filter that can filter out ore particulates before gases enter the off-gas system (800).

Off-Gas System. As discussed above, the off-gas system (800) runs at a vacuum or below atmospheric pressure. This causes gases to flow from the bag house (700) to the off-gas system (800). The off-gas system (800) uses known methods to filter sulphur and other harmful gases that are received from the AMT Reactor™ (10) before release of neutral gases into the atmosphere.

Secondary Melt System. In some cases, even after processing ore through the AMT Reactor™ (10), valuable metal may remain difficult to extract. In this case, the ore is processed through a Secondary Melt System (900). This system can be an inductive heat system or a smelter, for example.

Process Optimization. For the Inventive System to work optimally, the feed ore is delivered into the feed chamber (100) as a fine mesh size and at a moisture level between 0-20%. Ore that has high moisture content will clump together. Clumped ore is heavier and falls through the reaction chamber (200) too quickly and, consequently, ore hang time is decreased. High moisture content also causes AMT Reactor™(10) consumables, such as the torch head, to burn out more quickly.

The reaction chamber (200) is prepared for processing ore by removing oxygen from the reaction chamber (200). This is done by using a vacuum pumping system. In a preferred embodiment, once the pressure in the reaction chamber (200) reaches close to 0 psia, the reaction chamber (200) is back-filled with burn gas. Optimally, the AMT Reactor™ (10) runs at approximately 0-2 psia. In a preferred embodiment, the reaction chamber (200) is maintained at about 3000° F. where the plasma torch runs at approximately 25,000° F. These parameters may vary depending on AMT Reactor™(10) size, type of ore, and feed rate.

What is claimed is:

1. A system for processing ore comprising:

(a) a reactor comprising a chamber having a first opening for accommodating entry of a plasma torch where said plasma torch operates in a non-transfer mode;

where said torch has an active end and an inactive end;

where said torch is operatively located through the first opening in an orientation with the active end extending into the chamber and away from the first opening and the inactive end is secured in the chamber proximate to the first opening;

where said chamber further comprises a second opening near the first opening for entry of ore and carrier gas having a constrained path into the chamber, the second opening being proximate to the first opening; the path of the ore and carrier gas being along the same axis in relation to the major axis of the plasma torch;

where said chamber is radially surrounded by inductive coils which deliver a high frequency alternating current creating a magnetic field which stirs ore as it passes through the reactor and assist in controlling reactor temperature;

(b) a bag house where said bag house comprises a plurality of filters to capture particulate ore;

(c) an off-gas system where said system comprises a filtering system to remove toxic gases exiting said reactor and bag house.

2. The system for processing ore of claim 1 further comprising a secondary melt system.

3. The system for processing from ore of claim 1 further comprising an input/output system which continuously monitors temperature and gases of said system preventing release of toxic chemicals, gases and water into the environment.

4. A method to process ore using the system of claim 1 comprising:

(a) aspirating the chamber of air;

(b) igniting the plasma torch;

(c) applying alternating current to the inductive coils;

(d) back-filling the reactor chamber with a mixture of feed ore and carrier gas.

* * * * *